US007079782B2

(12) United States Patent
Sone et al.

(10) Patent No.: US 7,079,782 B2
(45) Date of Patent: Jul. 18, 2006

(54) FUSER AND TEMPERATURE CONTROL METHOD

(75) Inventors: Toshihiro Sone, Yokohama (JP); Osamu Takagi, Chofu (JP); Satoshi Kinouchi, Tokyo (JP); Yoshinori Tsueda, Fuji (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 178 days.

(21) Appl. No.: 10/805,420

(22) Filed: Mar. 22, 2004

(65) Prior Publication Data

US 2005/0207774 A1 Sep. 22, 2005

(51) Int. Cl.
*G03G 15/20* (2006.01)

(52) U.S. Cl. ..... 399/69; 219/216; 399/43; 430/124

(58) Field of Classification Search ..... 399/69, 399/43, 67, 328, 320, 330, 70, 44, 94, 98, 399/9

See application file for complete search history.

(56) References Cited

U.S. PATENT DOCUMENTS 4,556,779 A * 12/1985 Hashimoto et al. ..... 219/216
5,504,567 A * 4/1996 Satoh et al. ..... 219/216 X
5,819,136 A * 10/1998 Tomita et al. ..... 399/69
6,026,273 A 2/2000 Kinouchi et al.
6,078,781 A 6/2000 Takagi et al.
6,087,641 A 7/2000 Kinouchi et al.
6,097,926 A 8/2000 Takagi et al.
6,137,985 A 10/2000 Kinouchi et al.
6,154,629 A 11/2000 Kinouchi et al.
6,337,969 B1 1/2002 Takagi et al.
6,345,169 B1 * 2/2002 Haneda et al. ..... 399/328
6,397,021 B1 * 5/2002 Hayashi et al. ..... 399/69
6,415,128 B1 7/2002 Takagi et al.
6,438,335 B1 8/2002 Kinouchi et al.
6,643,476 B1 11/2003 Kinouchi et al.
6,643,491 B1 11/2003 Kinouchi et al.
6,724,999 B1 4/2004 Kikuchi et al.
6,725,000 B1 4/2004 Takagi et al.
6,763,206 B1 7/2004 Kinouchi et al.
2002/0044789 A1 * 4/2002 Nanataki et al. ..... 399/69
2002/0186982 A1 * 12/2002 Tamaoki ..... 399/69
2003/0198481 A1 * 10/2003 Kikuchi et al. ..... 399/69
2003/0219271 A1 11/2003 Kinouchi et al.
2003/0227533 A1 * 12/2003 Yokoi ..... 347/156
2004/0141038 A1 7/2004 Takagi et al.
2004/0173603 A1 9/2004 Kinouchi et al.

(Continued)

FOREIGN PATENT DOCUMENTS

JP 11-272119 A * 10/1999

(Continued)

OTHER PUBLICATIONS

U.S. Appl. No. 10/799,770, filed Mar. 15, 2004, Kikuchi et al.

(Continued)

*Primary Examiner*—Sophia S. Chen
(74) *Attorney, Agent, or Firm*—Foley & Lardner LLP

(57) ABSTRACT

According to one aspect of the present invention, there is provided a fixing apparatus having a non-contact temperature detecting unit which detects temperature by sensing infrared rays emitted from the a heating roller. A difference between a real temperature and the temperature detected by the non-contact temperature detecting unit, which is produced by time-lag until reaching the infrared rays emitted from the heating roller, is corrected.

21 Claims, 6 Drawing Sheets

U.S. PATENT DOCUMENTS

| | | | |
|---|---|---|---|
| 2004/0175211 | A1 | 9/2004 | Sone et al. |
| 2004/0175212 | A1 | 9/2004 | Tsueda et al. |
| 2004/0179874 | A1 | 9/2004 | Kinouchi et al. |
| 2004/0184852 | A1 | 9/2004 | Takagi et al. |
| 2004/0188421 | A1 | 9/2004 | Takagi et al. |
| 2004/0188422 | A1 | 9/2004 | Wasai et al. |
| 2004/0238531 | A1 | 12/2004 | Kikuchi et al. |
| 2004/0265021 | A1 | 12/2004 | Kinouchi et al. |

FOREIGN PATENT DOCUMENTS

| | | | | |
|---|---|---|---|---|
| JP | 2000-227732 | A | | 8/2000 |
| JP | 2000-259033 | A | | 9/2000 |
| JP | 2001-34109 | A | | 2/2001 |
| JP | 2001-242743 | A | | 9/2001 |
| JP | 2001-272877 | A | * | 10/2001 |
| JP | 2002-318160 | A | * | 10/2002 |
| JP | 2003-229242 | A | * | 8/2003 |

OTHER PUBLICATIONS

U.S. Appl. No. 10/820,138, filed Apr. 8, 2004, Sone et al.
U.S. Appl. No. 10/805,514, filed Mar. 22, 2004, Kinouchi et al.
U.S. Appl. No. 10/805,308, filed Mar. 22, 2004, Tsueda et al.
U.S. Appl. No. 10/805,305, filed Mar. 22, 2004, Sone et al.

* cited by examiner

| Count number CN | Correction coefficient |
|---|---|
| Less than CN1 | +0 |
| CN1 or more and less than CN2 | +β1 |
| CN2 or more and less than CN3 | +β2 |
| CN3 or more and less than CN4 | +β3 |
| CN4 or more | No correction |

FUSER AND TEMPERATURE CONTROL METHOD

BACKGROUND OF THE INVENTION

1. Field of the Invention

The present invention relates to a fixing apparatus installed in image forming apparatuses, copiers, and printers where an image is formed on a transfer material by an electrophotographic process, for fusing and fixing a development agent placed on the transfer material to it.

2. Description of the Related Art

In copiers and printers using an electron process, it is known that a toner image formed on a photoconductive drum is transferred onto a transfer material and thereafter the toner image is fused in a fixing apparatus having a heating roller and a pressurizing roller and fixed onto the transfer material.

At this time, for controlling the temperature of the heating roller, a method of detecting the surface temperature of the heating roller by a detecting element, which is arranged in contact with the surface of the heating roller, has been known. However, the contact-type temperature detecting element slides on the surface of the heating roller, so that it may degrade the surface, thereby shortening the life of the heating roller. When the surface is degraded, the sensitivity of the detecting element decreases, with the result that the wrong temperature may be detected.

Also another method has been known which uses a temperature detecting element for detecting the temperature of a heating roller without being in contact with the heating roller by sensing infrared rays emitted from the heating roller.

However, the emission rate of infrared rays from a heating roller detected by the non contact temperature detecting element differs between the life-start time and the life-end time since the surface of the heating roller is gradually degraded while being in contact with a transfer material holding toner thereon. Since the degradation of the surface of the heating roller varies depending upon the type and size of a transfer material to be fed, the infrared ray emission rate varies in the longitudinal direction of the roller. To describe more specifically, since infrared ray emission rate changes, the time for the temperature detected by the non-contact temperature-detecting element to reach a predetermined temperature delays.

For example, Japanese Patent Application KOKAI Nos. 2001-242743 or 2000-259033 discloses a fixing apparatus in which the temperature of a heating roller is detected by a temperature-detecting element in contact with a non-paper-feeding area and a non-contact temperature-detecting element for detecting the temperature of a paper-feeding area. However, a time lag is produced since the sensitivity differs between the contact-type temperature detector and the non-contact temperature detector. Hence, it has been difficult to accurately detect the temperature of a heating roller.

Furthermore, Japanese Patent Application KOKAI No. 2000-227732 discloses a fixing apparatus in which the radiation emission rate from a heating roller installed therein is detected by a radiation-detecting unit. However, since the radiation-detecting device is installed in a fixing apparatus where toner and paper dust are scattered, wrong detection may occur due to smudges. To solve this, it is effective to provide not only cleaning means to the temperature detecting element but also cleaning means to the radiation detecting unit; however they increase cost. In addition, the infrared ray emission rate varies depending upon how significantly stained on the surface of the heating roller.

Furthermore, in Japanese Patent Application KOKAI No. 2001-34109 discloses a technique for correcting temperature based on the difference between the temperature detected by an infrared detecting member for detecting the amount of infrared rays and the temperature detected by surface temperature detecting means which includes a thermistor for correcting the temperature of the infrared detecting member.

In this way, in the case where a non-contact temperature-detecting element is used, when infrared ray radiation rate changes, the temperature of the heating roller cannot be sensed accurately. Since heating means for heating the heating roller control heat generation depending upon the surface temperature of the heating roller inaccurately detected, the heating roller is not controlled at a proper temperature.

BRIEF SUMMARY OF THE INVENTION

According to an aspect of the present invention, there is provided a fixing apparatus comprising:

a heating roller a surface of which is formed of a conductive material;

a heating unit which heats the heating roller;

a temperature detecting mechanism having one or more non-contact temperature detecting units which are arranged in non-contact with the surface of the heating roller and which detect the surface temperature of the heating roller by sensing infrared rays emitted from the heating roller; and a correction circuit which corrects information as to the surface temperature of the heating roller output from the non-contact temperature detecting unit(s) based on a predetermined correction coefficient.

According to another aspect of the present invention, there is provided a method of controlling temperature comprising:

detecting the temperature of a heating roller by use of a non-contact temperature-detecting unit;

correcting the detected temperature based on a predetermined correction coefficient when the temperature detected by the non-contact temperature detecting unit falls within a temperature correction range.

According to a further aspect of the present invention, there is provided a fixing apparatus comprising:

a heating roller a surface of which is formed of a conductive material;

a heating unit which heats the heating roller;

a temperature detecting mechanism including a temperature detecting unit and a signal output section;

the temperature detecting unit which is arranged in non-contact with the surface of the heating roller and detects the surface temperature of the heating roller by sensing infrared rays emitted from the heating roller; and in which the signal output section which is arranged at a predetermined site rarely affected by infrared rays emitted from the heating roller and which converts the information as to the surface temperature of the heating roller from the temperature detecting unit into an electric signal.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

An example of a fixing apparatus to which an embodiment of the present invention can be applied will be explained with reference to the accompanying drawing.

First Embodiment

Figures 1, 4:
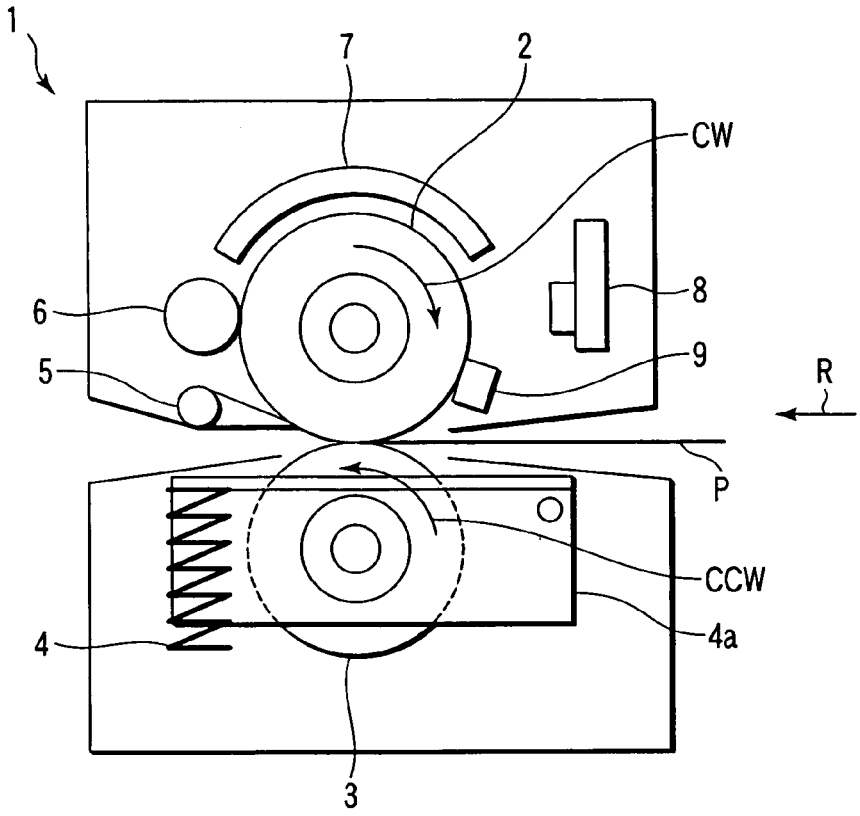
FIG. 1 is a schematic view explaining the structure of a fixing apparatus to which a first embodiment of the present invention can be applied.
FIG. 4 is a reference table explaining how to obtain a correction coefficient used in a temperature controlling method applicable to a fixing apparatus according to the present invention.

FIG. 1 shows a fixing apparatus to which an embodiment of the present invention can be applied.

As shown in FIG. 1, a fixing apparatus 1 has a heating roller 2, pressurizing roller 3, pressurizing spring 4, separation nail 5, cleaning roller 6, heat-induction unit 7, temperature detecting mechanism 8 and thermostat 9.

The heating roller 2 has a surface formed of an conductive member composed of iron, stainless steel, nickel, or an alloy of aluminum and stainless steel.

The pressurizing roller 3 is an elastic roller formed of a rotation axis having a predetermined diameter covered with a silicon rubber or fluorine rubber of a predetermined thickness.

The pressurizing spring 4 applies a predetermined pressure to the axis of the heating roller 2 such that the pressuring roller 3 is maintained in posture almost in parallel to the axis of the heating roller 2. On the other hand, the pressurizing spring 4 can be maintained in parallel to the heating roller 2 since predetermined pressure is applied to the pressurizing spring 4 from both ends of the pressurizing roller 3 via a pressurizing support bracket 4*a* for supporting the axis of the pressurizing roller 3.

By virtue of this, a nip of a predetermined width is formed between the heating roller 2 and pressurizing roller 3.

The heating roller 2 is rotated in a direction indicated by the arrow, CW, at substantially a constant rate by a fixing apparatus motor 32, which will be explained later with reference to FIG. 2, or a main motor 33 for rotating a photoconductive drum 34 shown in the same figure. The pressurizing roller 3, since it is in contact with the heating roller 2 by means of the pressurizing spring 4, is rotated in a reverse direction of the rotation direction of the heating roller 2 at a position in contact with the heating roller 2 when the heating roller 2 is rotated.

The separation nail 5 is set around the heating roller 2 and at a predetermined position which is specified by being downstream of the nip at which the heating roller 2 and the pressurizing roller 3 are in contact with each other, in the rotation direction of the heating roller 2 and in the proximity of the nip. The separation nail 5 plays a role of separating a paper sheet P passing through the nip from the heating roller 2. Note that the present invention is not limited to this embodiment. For example, when a large amount of developing agent is used for forming a color image on a paper sheet by fusing, it is difficult to separate the paper sheet from the heating roller. Therefore, in such a case, a plurality of separation nails 5 may be provided, whereas a separation nail may not be provided when a paper is easily separated.

The cleaning roller 6 removes debris such as toner or paper dust coming off on the surface of the heating roller 2.

The heat-induction unit 7 is arranged outside the heating roller 2 and has at least one heating coil (magnetizing coil), which applies a predetermined magnetic field to the heating roller 2 when a predetermined electric power is supplied. When the predetermined electric power is supplied from a magnetizing circuit 22 to the heating coil, the heating roller 2 is heated to a predetermined temperature.

The temperature detecting mechanism 8 is arranged in no contact with the surface of the heating roller 2 for detecting the temperature of the outer surface of the heating roller 2. To explain more specifically, the temperature detecting mechanism 8 is arranged downstream of the position of the heat-induction unit 7 in the rotation direction of the heating roller 2 and arranged upstream of the nip portion, and plays a role of detecting the surface temperature of the heating roller 2 heated by the heat-induction unit 7.

The thermostat 9 senses abnormal heating, a phenomena where the surface temperature of the heating roller 2 abnormally increases. When heat is abnormally generated, the thermostat 9 shuts off the power to be supplied to the heating coil of the heat-induction unit 7. It is preferable that at least one thermostat 9 is arranged near the surface of the heating roller 2.

Around the pressurizing roller 3, a separation nail (not shown) for separating a paper sheet P from the pressurizing roller 3 and a cleaning roller (not shown) for removing toner deposited on the circumference surface of the pressurizing roller 3 may be provided.

When a paper sheet P holding toner T thereon passes through the nip portion formed between the heating roller 2 and the pressurizing roller 3, the toner T is molten and pressed onto the sheet P to fix an image on the paper.

Figure 2:
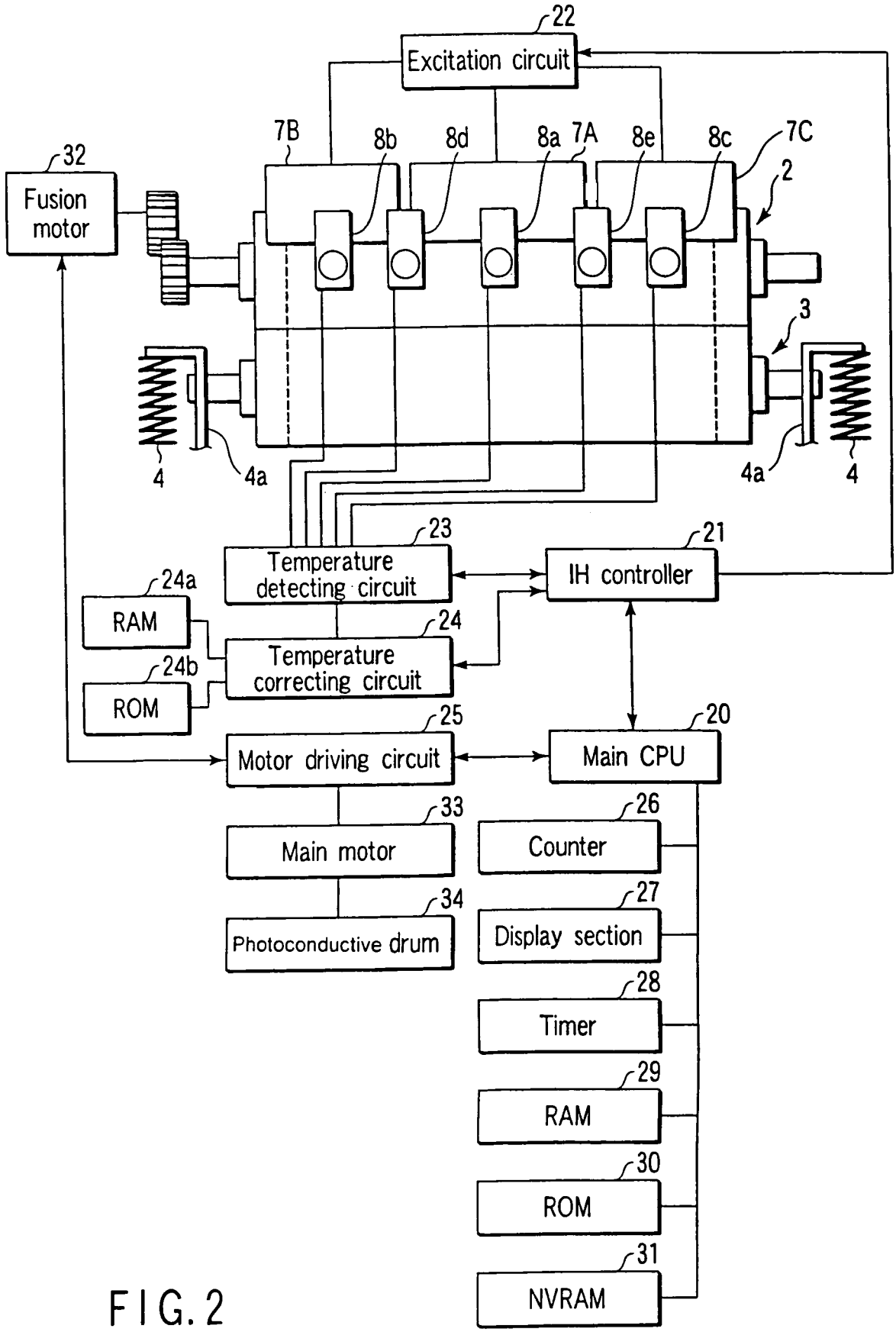
FIG. 2 is a block diagram explaining the control system of the fixing apparatus shown in FIG. 1.

FIG. 2 shows a block diagram explaining the control system of the fixing apparatus shown in FIG. 1 and also shows a schematic view of the fixing apparatus as seen from the arrow R.

As shown in FIG. 2, the heat-induction unit 7 includes induction heating coils 7A, 7B and 7C. The heating coils 7A is arranged along the axial direction of the heating roller 2 so as to face the center portion thereof and applies a magnetic field to the center portion. Coils 7B and 7C are arranged along the axial direction of the heating roller 2 so as to face the lateral portions thereof to apply magnetic fields to the both lateral portions.

The temperature detecting mechanism 8 includes a plurality of non-contact temperature detecting elements, for example, 8*a*, 8*b*, 8*c*, 8*d*, and 8*e*, which are arranged along the longitudinal direction of the heating roller 2. For example, the non-contact temperature detecting element 8*a* is arranged so as to face the coil 7A; the non-contact temperature detecting element 8*b* is arranged so as to face the coil 7B. The non-contact temperature detecting element 8*c* is arranged so as to face the coil 7C. The non-contact temperature detecting element 8*d* is arranged so as to face the joint between the coil 7A and the coil 7B. The non-contact temperature detecting element 8*e* is arranged so as to face the joint between the coil 7A and the coil 7C.

In this way, it is preferable that the temperature detecting elements 8 be arranged so as to face the centers of the coils and the joints of adjacent coils of the induction-heating unit 7. More specifically, the number of coils (CX) arranged in the heat-induction unit 7 and the number (SY) of non-contact temperature detecting elements arranged in the temperature detector mechanism 8 preferably satisfy the following equation: SY=2CX−1.

The non-contact temperature detecting elements 8*a* to 8*e*, each may have an infrared-ray sensing section for converting infrared radiation energy from the heating roller 2 into electric power and a temperature signal circuit board for converting the electric power from the infrared-ray sensing section to an electric signal. As the infrared-ray sensing section, a thermopile generating electromotive force due to, for example, the Seebeck effect, an infrared ray sensor for sensing a temperature change due to the pyroelectric effect may be used.

As shown in FIG. 2, a main CPU 20 is connected (directly or indirectly) to an IH controller 21, an excitation (magnetization) circuit 22, a temperature detecting circuit 23, a temperature correcting circuit 24, a motor driving circuit 25, a counter 26, a display section 27, a timer 28, RAM 29, ROM 30, and NVRAM 31.

The main CPU 20 integrally controls the fusing/fixing operation of the fixing apparatus 1.

The IH controller 21 outputs a driving signal to the excitation circuit 22 to allow the heat-induction unit 7 to supply a predetermined electric power. More specifically, the IH controller 21 controls the temperature of the heating roller 2 so as to be set at a temperature required for fusing/fixing based on the temperature information of the heating roller 2 output from the temperature detecting circuit 23, directly or via the temperature correcting circuit 24. Note that, as shown in this embodiment, in the case where a temperature detecting mechanism including a plurality of temperature detecting units capable of detecting a plurality of sites of the heating roller is used, it is preferable that the temperature detecting units are arranged both upstream and downstream of the nip so as to ensure a temperature difference (ripple) between the upstream site and downstream sites falls within a predetermined range.

The excitation circuit 22 supplies to a predetermined amount of power to coils 7A to 7C in response to the magnetization signal output from the IH controller 21. By supply a predetermined amount of power, each of the coils 7A to 7C generates predetermined magnetic flux serving as "heating power". The "heating power" is defined as the magnitude of magnetic flux which permits the heating roller 2 to generate spiral current and which is determined by the magnitude of electric power supplied to each of the coils 7A to 7C. For example, when a paper sheet passes through the center portion of the heating roller 2, a predetermined electric power is generated for magnetizing the coil 7A. On the other hand, when a paper sheet passes through the center portion and the lateral portions of the heating roller 2, a predetermined amount of power, for example, 1,300W, is generated to magnetize the coils 7A to 7C.

The temperature detecting circuit 23 is connected to non-contact temperature detecting elements 8*a* to 8*e* and outputs a temperature detection signal, which is temperature information of the heating roller 2 detected. In this embodiment, the following explanation will be made by designating the temperature information of the heating roller 2 detected by the non-contact temperature detecting element 8*a* as a temperature detection signal SG1. Note that the temperature detecting circuit 23 can output temperature detection signals SG2, SG3, SG4 and SG5, which are temperature information respectively obtained by other non-contact temperature detecting elements 8*b* to 8*e*.

The temperature correcting circuit 24 is connected to a RAM 24*a* which stores a predetermined correction coefficient, which will be described later, a ROM 24*b* which is an operation area in which a correction operation is performed based on the temperature detection signal SG1. The temperature correcting circuit 24 carries out temperature correction and outputs a correction value CV1 obtained through calculation performed from the correction coefficient and the temperature detection signal SG1.

The motor driving circuit 25 is connected to a fusion motor 32 for rotating the heating roller 2 or may be connected to a main motor 33 for rotating a photoconductive drum 34.

The counter 26 counts the rotation number of the heating roller 2 rotated by the fusion motor 32, the rotation number of the photoconductive drum 34 rotated by the main motor 33, or the number CN of paper sheets on which an image is to be fused and fixed, that is the number of paper sheets passing through the space between the heating roller 2 and pressurizing roller 3. The counter 26 may count the number of paper sheets P1 which pass through the space between both rollers 2 and 3 in contact with the center axial portion separately from the number of paper sheets P2 in contact with the entire surface including the center and lateral axial portions.

The display section 27 displays a serviceman inspection mode which informs that it is time for cleaning and exchanging the heating roller 2 and for cleaning for the temperature detecting mechanism 8.

The timer 28 detects the elapsed time ET from the power is turned on. For example, W/UT1, W/UT2, W/UT3 requiring for warming-up can be detected. The RAM 29 temporarily stores predetermined information detected by the counter 26 and the timer 28. The ROM 30 stores an initial program and fixed information.

NVRAM 31 stores the number of fixation paper sheets counted by the counter 26 and the rotation number of the heating roller 2 or the rotation number of the photoconductive drum 34. These numbers are stored while renewing and the stored numbers will not disappear when the power is turned off. The number CN of the fixation paper sheets includes the count numbers CNP1 and CNP1 corresponding to paper sheets P1 and P2.

Next, correction operation of temperature carried out by the temperature correcting circuit 24 will be explained.

A method how to correct the temperature by a fixing apparatus according to the present invention will be explained with reference to FIG. 3.

Figure 3:
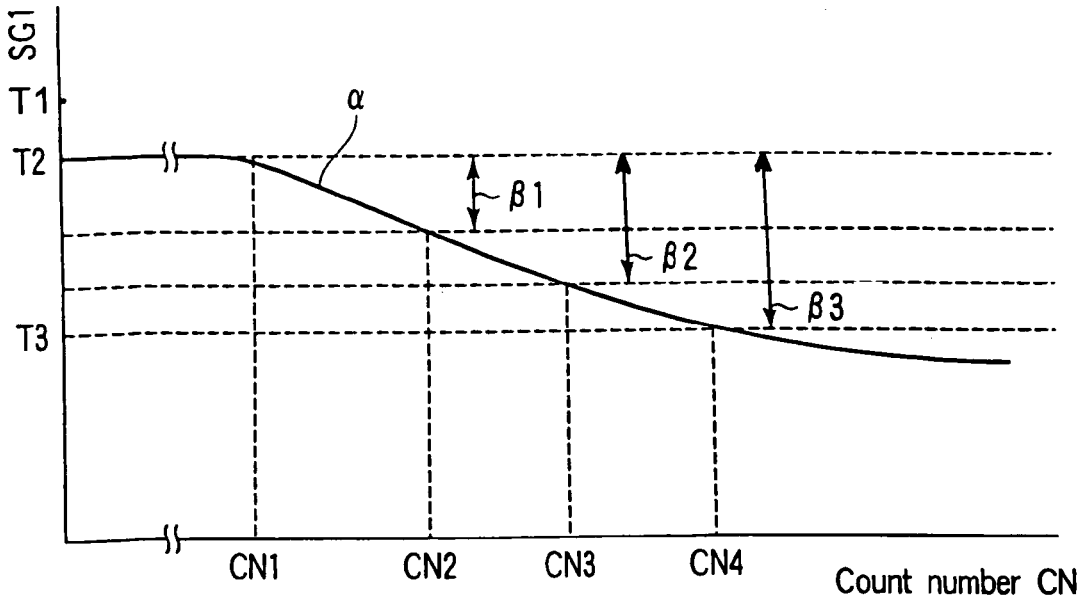
FIG. 3 is graph showing a method of controlling temperature applicable to a fixing apparatus according to the present invention.

As shown in FIG. 3, the lateral axis shows the count number CN of the fixation sheets counted by the counter 26 and the longitudinal axis shows the temperature detected by the non-contact temperature detecting element 8*a*, represented by the detected-temperature signal SG1.

Curve α shows a change of the detected-temperature signal, SG1 with an increase of the sheet number of the fixation papers (count number CN) when power E1 is supplied to coils 7A to 7C of the heat-induction unit 7 as heating power, in order to heat the heating roller 2 to a predetermined temperature T1. As shown by Curve α, the non-contact detecting element 8*a* (temperature detecting mechanism 8) detects temperature information T2 by infrared rays emitted from the heating roller 2 which is heated to a predetermined temperature T1 when power E1 is supplied to the induction-heating unit 7, and outputs the detection temperature signal SG1 including the temperature information T2, to the IH controller 21, until reaching, for example, the count number CN1.

However, as the heating roller 2 comes closer to the end of the life which means that exchange/cleaning of the heating roller 2 is required, the infrared radiation rate of the heating roller 2 decreases or the temperature detecting mechanism 8 (non-contact temperature detecting element 8*a*) gets dirty. As a result, as shown by Curve α, the detection temperature that is, the detection temperature signal SG1, gradually decreases. In other words, despite the fact that constant power E1 is supplied to the heat-induction unit 7, that is, the same heating power, is supplied to the heating roller 2, the temperature detected by the temperature detecting mechanism 8 (non-contact temperature detecting element 8*a*) in the beginning differs from that detected by the end of the life.

A temperature correction method according to the present invention is characterized in that, while the temperature difference, that is, the detection temperature signal SG1, falls within a range of temperature information T2 to T3 (temperature correction range), temperature correction is performed, and when the temperature difference reaches the detection temperature information T3 (cleaning/exchange range), the cleaning of the temperature detecting mechanism 8 or the cleaning/exchange of the heating roller 2 is instructed.

The correction coefficient (β1, β2, β3) may be defined in accordance with a predetermined table indicating the difference of temperature detection signal SG1 defined depending upon the count number of fixation sheets, in the conditions where constant power E1 is supplied to the heat-induction unit 7, as shown in FIG. 3. More specifically, in this embodiment, the table shown in FIG. 4 may be used.

As shown in FIG. 4, the temperature correcting circuit 24 outputs, to the IH controller 21, the correction value CV1 which is obtained by adding, a correction coefficient (β1, β2, β3), that is, correction temperature, to the detected temperature signal SG1 output from the temperature detecting circuit 23 as the detected temperature of the heating roller 2. Note that, when the correction temperature is performed based on the correction coefficient (β1, β2, β3) shown in FIG. 4, the temperature of the heating roller 2 after the correction avoids being lower than the real temperature of the heating roller 2 shown in FIG. 3. As a result, it is possible to prevent detecting the temperature of the heating roller at a value lower than the real temperature of the heating roller 2, thereby preventing outputting a larger power to the heat-induction unit 7.

Next, an example how to warming up a fixing apparatus of the present invention will be explained.

Figure 5:
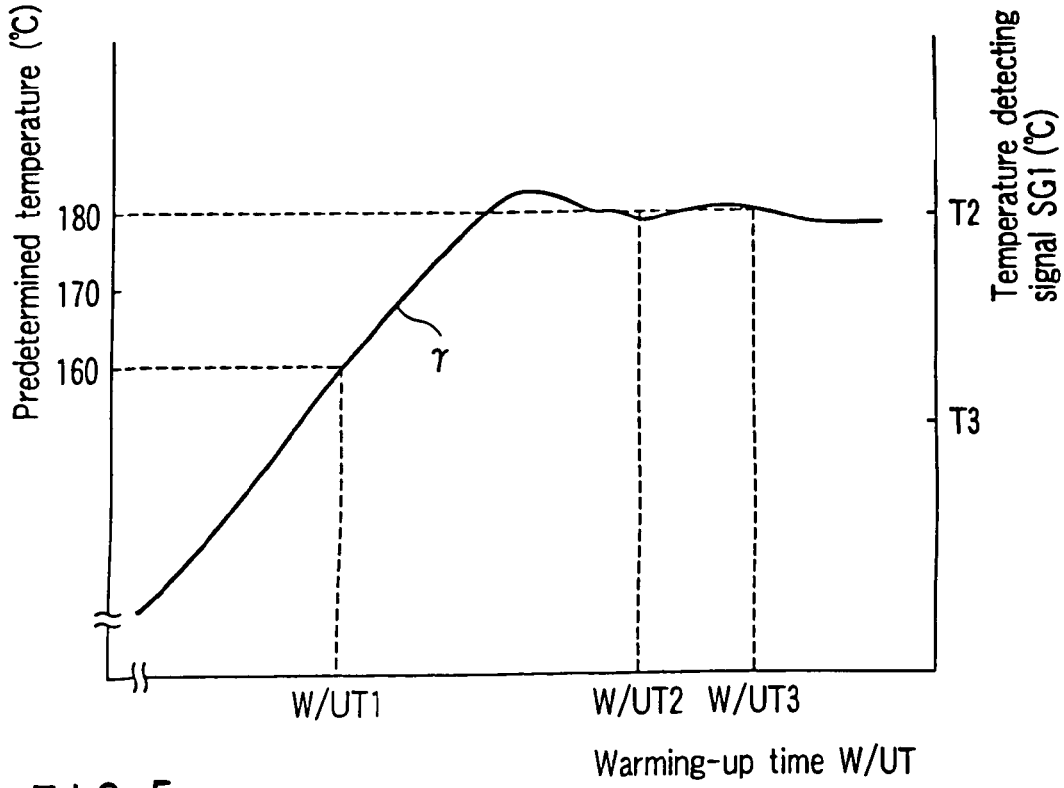
FIG. 5 is a graph showing the temperature versus the warming-up time of the charger shown in FIG. 1.

FIG. 5 shows time versus temperature during the warming-up process.

As shown in FIG. 5, the lateral axis shows warming-up time W/UT measured by a timer 28. The left longitudinal axis shows a predetermined surface temperature of the heating roller 2 and the right longitudinal axis shows the detected temperature signal SG1, that is, the temperature detected by the temperature detecting mechanism 8. The temperature detecting mechanism 8 detects the temperature of the heating roller 2 by sensing infrared rays emitted therefrom to obtain the detected temperature (for example, T2 or T3), which therefore does not coincide with the temperature of the heating roller 2 shown on the left longitudinal axis. Needless to say, the detected temperature is information as to the temperature of the heating roller obtained after a predetermined arithmetic calculation is applied.

Curve γ shows a temperature change with time during the warming-up process where the heating roller 2 is warmed up to a predetermined temperature, 180° C. In this embodiment, the time periods for first, second, third warming-up for a fixing apparatus are set up as shown by Curve γ. The first warming-up time W/UT1 is the time period required for generating heat from the heating roller 2, at, for example, 160° C., which is lower by a predetermined value than the predetermined temperature, 180° C. The second warming-up time, W/UT2, is a time point at which the heating roller 2 has reached the predetermined temperature 180° C., more specifically, the time period including a predetermined allowance of time after the time the heating roller 2 has reached the predetermined temperature, 180° C. The third warming-up time W/UT3 is the time when a correction time has passed after the second warming-up time W/UT2, in other words, the time at which the warming-up is completed.

The temperature sensing circuit 23 outputs the temperature information T2 as the temperature detection signal SG1 when the temperature of the heating roller 2 is 180° C. The temperature information T3 is lower than the temperature information T2, as indicated on the right longitudinal axis and preferably lower than the temperature (160° C.) of the first warming-up time W/UT1. In this embodiment, the temperature information T3 is defined as the temperature at which exchange or cleaning of the unit is instructed in the exchange/cleaning cycle (PM cycle), if the temperature does not reach T3 even after the first warming-up time W/UT1 has passed. Furthermore, the temperature correction according to this embodiment is preferably performed during the warming up and preferably the temperature information T3 is not near 160° C. This is because when temperature correction is carried out by reducing the temperature of the heating roller by the fusing/fixing operation, the fusing/fixing control may be confused.

Referring to the flowchart shown in FIG. 6, how to operate the fixing apparatus of the present invention will be explained.

Figure 6:
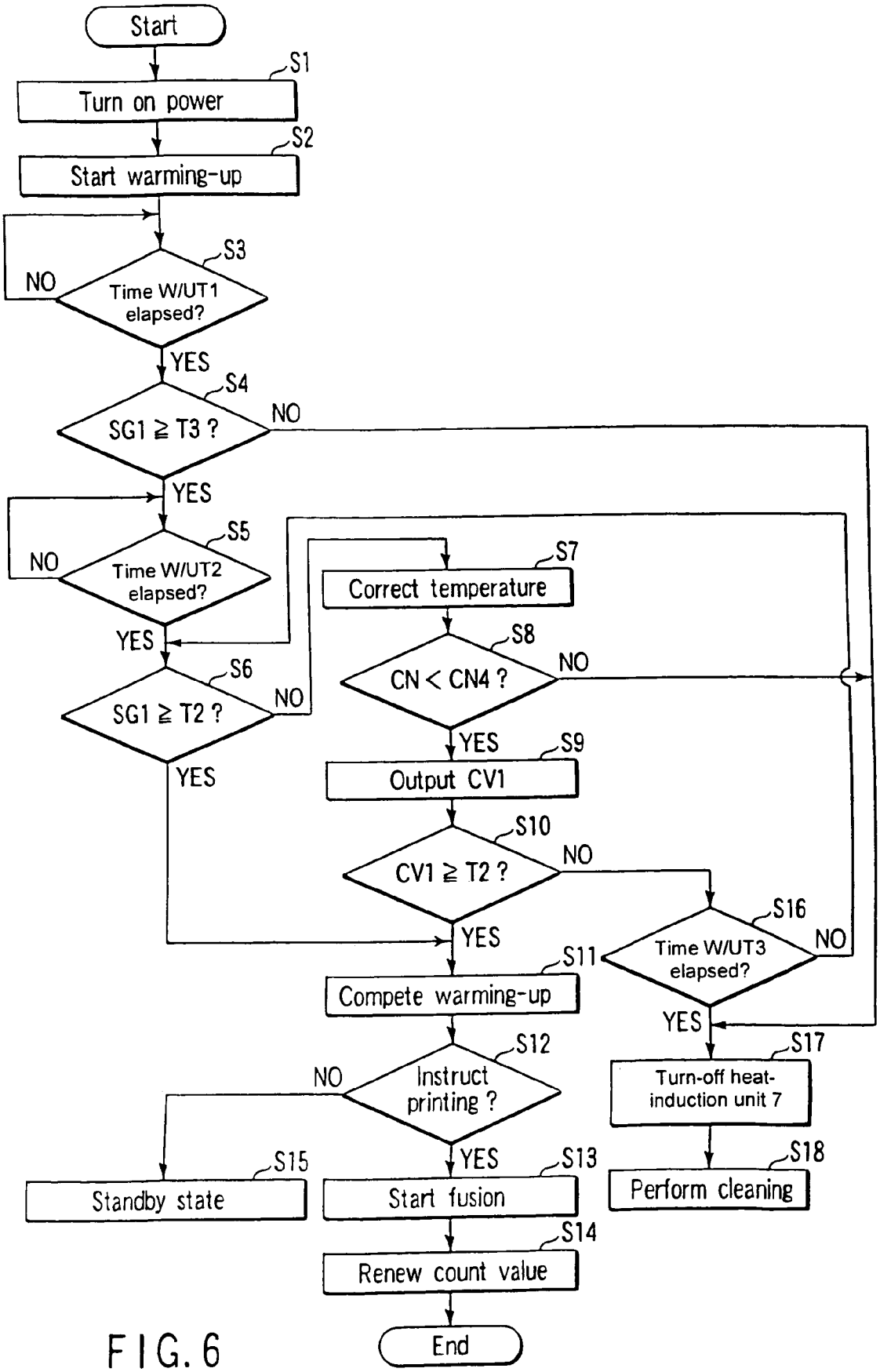
FIG. 6 is a flowchart explaining the operation of the fixing apparatus shown in FIG. 1.

As shown in FIG. 6, when the fixing apparatus is turned on (S1) to supply the power to the temperature detecting mechanism 8, warming up is initiated (S2). The IH controller 21 supplies a magnetization signal to the excitation circuit 22. When a predetermined amount of power is supplied to the heat-induction unit 7, the temperature of the heating roller rises.

When the first warming-up time W/UT1 is measured by a timer 28 (S3-YES), whether the temperature detection signal SG1 output from the temperature sensing circuit 23 is equal to or greater than the temperature information T3 or not is determined (S4).

When the temperature detection signal SG1 is greater than the temperature information T3 (S4-YES), the second warming-up time W/UT2 is further measured by the timer 28 (S5-YES) and thereafter whether the temperature detection signal SG1 is equal to or greater than the temperature information T2 or not is determined (S6).

When the temperature detection signal SG1 is lower than the temperature information T2 (S6-NO), the temperature is corrected (S7) in the manner mentioned above. More specifically, a predetermined correction is performed depending upon the count number of fixation paper sheets counted by the counter 26. When the count number CN is smaller than the count number CN4 (S8-YES), a correction value CV1 (correction coefficient varied depending upon the count number CN is added to the temperature detection signal SG1), as shown in FIG. 4, is output from the temperature correcting circuit 24 (S9).

Whether the output correction value CV1 is equal to or greater than the temperature information T2 or not is determined (S10). When the correction value CV1 is the temperature information T2 or more (S10-YES), the warming up is terminated (S11). When a printing instruction (fixing instruction) is given (S12-YES), the fixing operation is started (S13) and the number of fixation paper sheets counted by the counter 26 is renewed (S14). The count number renewed is stored in NVRAM 31 whose memory will not be erased even if the power is turned off. When the printing instruction is not given (S12-NO), the heating roller is maintained at a predetermined temperature as the stand-by state (S15).

On the other hand, in Step S10, when the correction value CV1 is lower than the temperature information T2 (S10-NO), the warming-up operation is carried out until a predetermined time passes. More specifically, when time does not reach the third warming-up time W/UT3 (S16-NO), the operation goes back to step S6 where, whether or not the temperature detection signal SG1 is equal to or greater than the temperature information T2 is determined (S6).

When the time reaches the third warming-up time W/UT3 (S16-YES) or when the temperature detection signal SG1 is lower than the temperature information T3 in Step S4 (S4-NO), or when the count number CN is equal to or greater than CN4 in step S8 (S8-NO), the warming-up process is terminated and then the power to be supplied to the heat-induction unit 7 is stopped (S17), and then the serviceman inspection mode is displayed on the display section 27 to inform that the heating roller 2 must be exchanged and the temperature detecting mechanism 8 must be cleaned (S18).

The correction coefficient is not limited to the example shown in FIG. 4. The correction coefficient may be a predetermined value which is determined depending upon the material, thickness or size of an image recording medium to be fed, or a feeding speed of the medium, the rotation number of the heating roller 2 and the rotation number of the photoconductive drum 33 counted by the counter 26.

The temperature detecting mechanism 8 containing five non-contact temperature detecting elements, 8*a*, 8*b*, 8*c*, 8*d*, and 8*e*, has been explained. The present invention is not limited to this. The temperature detecting mechanism 8 may contain at least one non-contact temperature-detecting element of 8*a* and 8*b*.

Furthermore, as means for generating heat from the heating roller 2, a heat-induction unit 7 is mentioned. However, the present invention is not limited to this. A lamp may be arranged within the heating roller 2.

In this embodiment, the temperature detection signal SG1 output from the temperature detecting circuit 23 has been explained. However, temperature correction can be performed as to the temperature detection signals SG2, SG3, SG4, and SG5, which are temperature information based on other non-contact temperature detecting elements 8*b* to 8*e*.

Next, a moving mechanism for moving the temperature detecting mechanism 8 will be explained.

Figure 7:
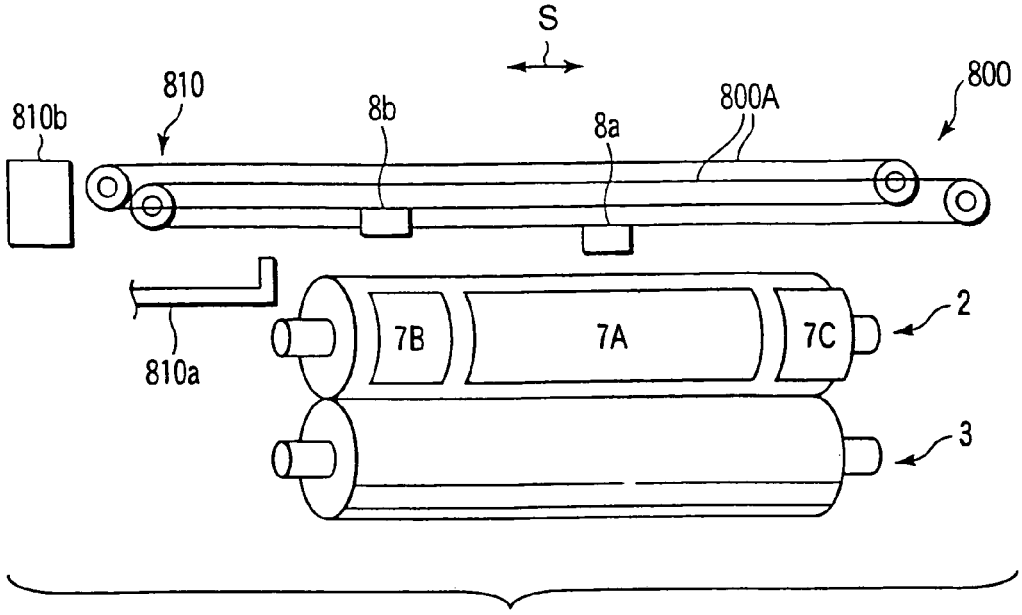
FIG. 7 is a schematic view of an example of a moving mechanism for moving the temperature detecting mechanism.

As shown in FIG. 7, the non-contact temperature detecting elements 8*a* and 8*b* constituting the temperature detecting mechanism 8 may be arranged movably by the moving mechanism 800 in the axial direction S.

Figure 8:
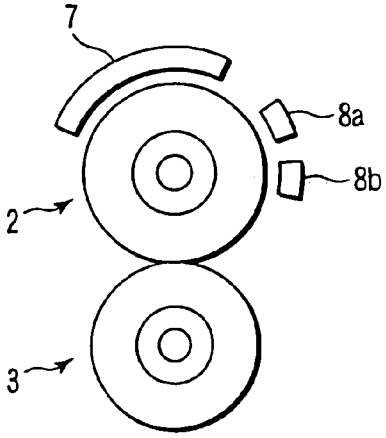
FIG. 8 is a schematic side view of the moving mechanism shown in FIG. 7.

The movable mechanism 800 has a lope-form moving mechanism 800A, which is moved in the axial direction S by a motor (not shown). The moving mechanism 800A holds the non-contact temperature detecting elements 8*a* and 8*b* at different phases along the rotation direction of the heating roller 2, as shown in FIG. 8. The non-contact temperature detecting elements 8*a* and 8*b* are preferably arranged in the same distance apart from the surface of the heating roller 2. The moving mechanism 800A is not limited to a lope-form. A belt-form and a rack-and-pinion form may be employed.

The moving mechanism 800 moves non-contact temperature detecting elements 8*a* and 8*b* to predetermined detection positions near the surface of the heating roller 2 when heat is generated from the heating roller 2 by the fusing/fixing operation and moves them back to a standby area 810 formed at one end of the moving mechanism 800 in the axial direction. The stand-by area 810 may be separated, by a dustproof wall 810*a* formed near the heating roller, from the heating roller 2, around which toner and dust are scattered by the fixing operation. Furthermore, at a predetermined position of the stand-by area 810, a temperature-detecting element cleaning mechanism 810*b* may be provided for cleaning the non-contact temperature detecting elements 8*a* and 8*b* moved to the stand-by area 810.

Figure 9:
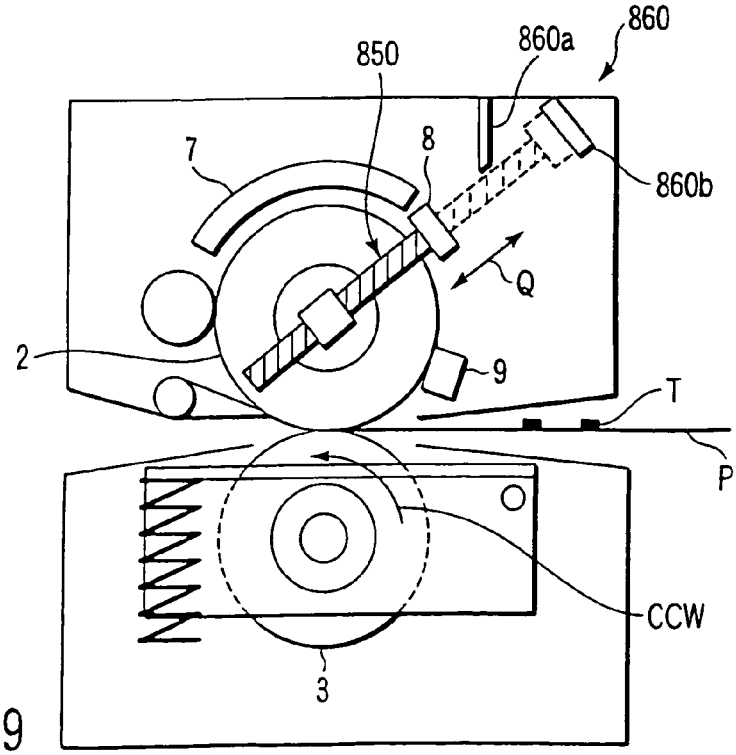
FIG. 9 is a schematic view showing another moving mechanism for moving the temperature detecting mechanism shown in FIG. 1.

As shown in FIG. 9, the temperature detecting mechanism 8 may be provided movably by the moving mechanism 850 in the direction of the arrow Q, which is perpendicular to the axial direction S of the heating roller 2.

The moving mechanism 850 has moving means, which is constituted of a drive shaft having a spiral cut formed therein and a temperature-detecting mechanism holding member engaged with the spiral cut and movably formed along the axial direction of the drive shaft. The non-contact temperature detecting elements 8*a* to 8*e* of the temperature detecting mechanism 8 are arranged such that they are respectively arranged at the predetermined temperature detection positions of the temperature detecting mechanism holding member when the heating roller 2 generates heat by the fusing/fixing operation. In operations other than fusing/fixing, the non-contact temperature detecting elements 8*a* and 8*b* are moved in the direction of the arrow Q and placed in the stand-by area 860. In the stand-by area 860, a dustproof wall 860*a* and the temperature detecting element cleaning mechanism 860*b* may be provided similarly in the stand-by area 810.

As described, in the present invention employing a non-contact temperature detecting mechanism, since it impossible to prevent a sliding trace from being formed on the surface of the heating roller 2 unlike the case of using the contact-type temperature detecting mechanism. Therefore, the life of the heating roller 2 can be extended.

Since the detected temperature is corrected by the correction coefficient previously set, the temperature of the heating roller can be quickly increased. As a result, the warming-up time can be reduced. Furthermore, it is possible to prevent the corrected temperature of the heating roller 2 from decreasing the predetermined temperature of the heating roller 2. As a result, the heat-generation efficiency can be improved.

The temperature detecting mechanism 8, when the sensitivity of the mechanism deteriorates due to smudge, is cleaned by the serviceman inspection mode or the temperature-detecting element cleaning mechanisms 810*b* and 860*b*. Therefore, the life of the mechanism 8 is extended and the deterioration of temperature detection characteristics can be prevented. In addition, it is possible to prevent the temperature detecting mechanism 8 from detecting the wrong temperature, thereby preventing trouble in temperature control of the heating roller performed based on the temperature detected.

Second Embodiment

Next, referring to FIGS. 10 and 11, the second embodiment will be explained. With respect to the structural elements shown in FIGS. 10 and 11, like reference numerals are used to designate like structural elements corresponding to those like in the first embodiment and any further explanation is omitted for brevity's sake.

Figure 10:
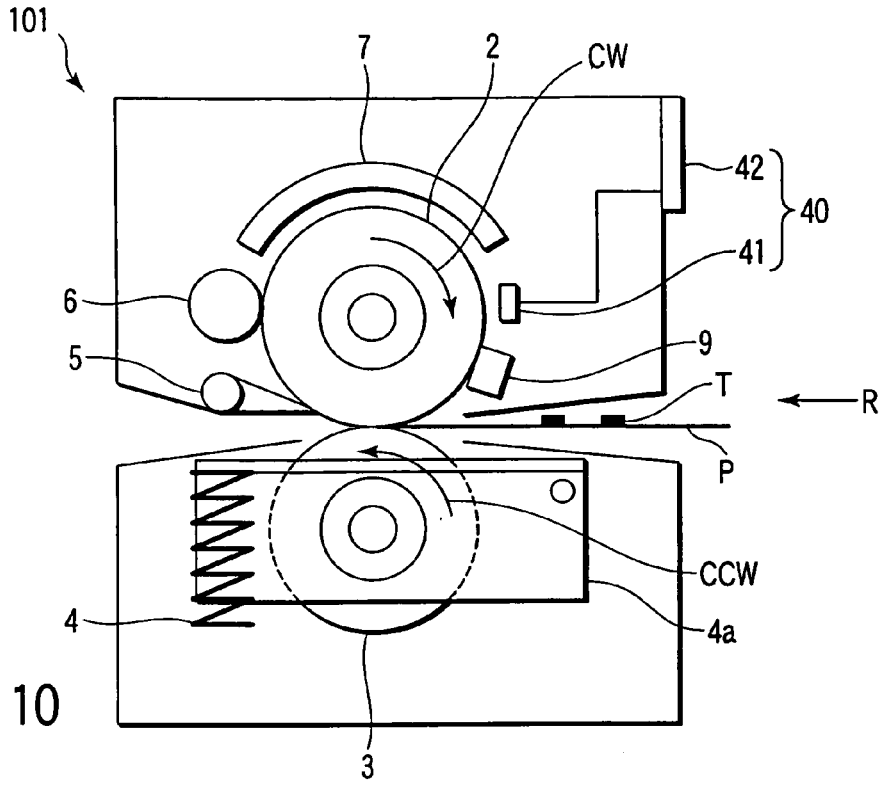
FIG. 10 is a schematic figure of a fixing apparatus according to a second embodiment.

FIG. 10 shows an example of a fixing apparatus to which a second embodiment is applied.

As shown in FIG. 10, a fixing apparatus 101 has a temperature detecting mechanism 40. The temperature detecting mechanism 40 is provided in no contact with the surface of the heating roller 2 and has an infrared-ray sensing unit 41 which converts infrared radiation energy from the heating roller 2 to electric power and a temperature signal circuit board 42 which converts the electric power from the infrared-ray sensing unit 41 into an electric signal.

The infrared sensing unit 41 is provided in the close proximity of the surface of the heating roller 2, for detecting the temperature of the heating roller 2 by sensing the infrared rays emitted from the heating roller 2. As the infrared-ray sensing unit 41, a thermopile which produces electromotive force due to, for example, the Seebeck effect, or an infrared-ray sensor for sensing a temperature change due to the pyroelectric effect.

The temperature signal circuit board 42 is provided at a place rarely affected by infrared rays emitted from the heating roller 2 or thermal convection, more specifically, outside the case of a fixing apparatus 101. Alternatively, the temperature signal circuit board 42 is held in a case which can mitigate the effects of infrared rays and thermal convection or may be placed inside or outside the fixing apparatus 101.

Figure 11:
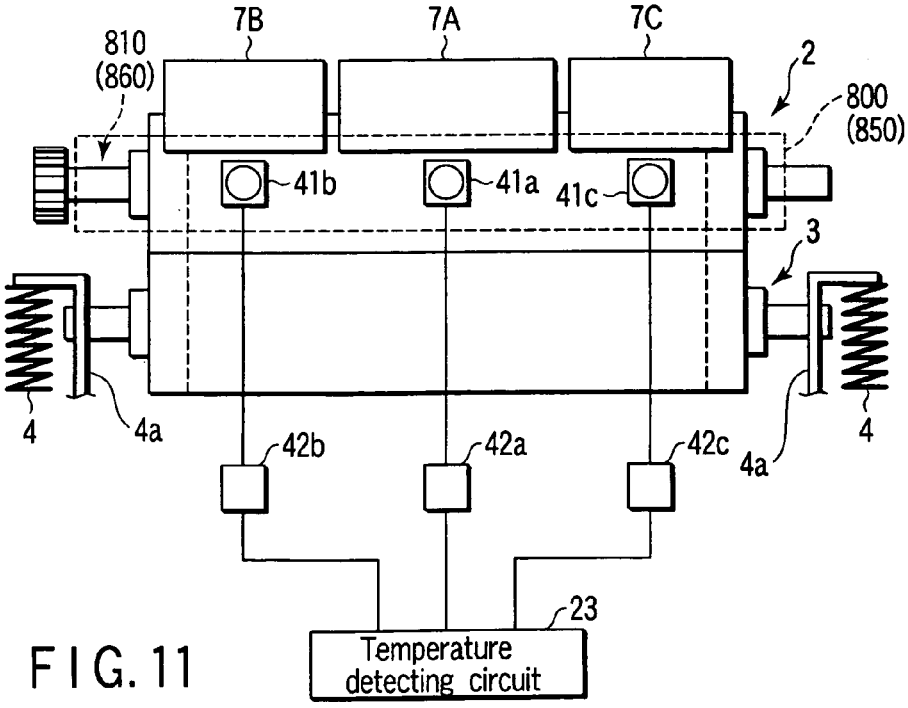
FIG. 11 is a schematic view of the fixing apparatus shown in FIG. 10.

FIG. 11 shows a schematic view of the fixing apparatus shown in FIG. 10 as seen from the arrow R and a temperature detecting mechanism 40.

As shown in FIG. 11, the temperature detecting mechanism 40 has a plurality of infrared detecting elements 41, more specifically, an infrared ray temperature detecting element 41*a* arranged so as to face a coil 7A, an infrared ray temperature detecting element 41*b* arranged so as to face a coil 7B, and an infrared ray temperature detecting element 41*c* arranged so as to face a coil 7C.

The temperature signal circuit board 42 includes a temperature signal circuit board 42*a* connected to the infrared ray temperature detecting element 41*a*, a temperature signal circuit board 42*b* connected to the infrared ray temperature detecting element 41*b*, and a temperature signal circuit board 42*c* connected to the infrared ray temperature detecting element 41*c*. These temperature signal circuit boards 42*a* to 42*c* are individually connected to the temperature detecting circuit 23 and individually output a data temperature signal. The temperature detecting circuit 23 outputs a temperature detection signal based on the data temperature signal. For example, the temperature signal circuit board 42*a* outputs a data temperature signal DG1 based on the temperature information detected by the infrared detecting element unit 41*a*, whereas the temperature detecting circuit 23 outputs a temperature detection signal SG1 based on the data temperature signal DG1. Note that the temperature signal circuit boards 42*b*, 42*c* output the data temperature signals DG2 and DG3, respectively, whereas the temperature sensing circuit 23 can output temperature detection signals SG2 and SG3 based on the data temperature signals DG2 and DG3, respectively. The temperature detecting signals SG1 to SG3 can be targets for temperature correction similarly in the first embodiment.

As described, by arranging non-contact type infrared sensing unit 41 for detecting the temperature by sensing infrared rays in the proximity of the heating roller 2, more accurate temperature information can be obtained and further the temperature detection characteristics can be improved. In addition, by arranging the temperature signal circuit board 42 at a site rarely affected by infrared rays, it is possible to prevent corruption of the temperature signal circuit board 42 and extend the life of the circuit board 42.

The infrared sensing unit 41 includes a warm contact section whose temperature is increased by absorbing infrared rays, and a cold contact section whose temperature is not increased since it is covered with heat sink. By virtue of the difference in temperature between the warm contact section and the cold contact section, electromotive force may be generated due to the Seebeck effect. In this case, since the cold contact section is preferably not affected by infrared rays and thermal convection, it may be arranged at a site free from the infrared rays and thermal convention, for example, by being integrally formed with the temperature signal circuit board 42.

The temperature detecting mechanism 40 has been explained which has three temperature detecting units and three temperature signal circuit boards. However, the present invention is not limited to this and may include at least one temperature detecting unit and temperature signal circuit board.

In this embodiment, the moving mechanisms 800 and 850 explained with reference to FIGS. 7 to 9 may be applied. The moving mechanism 800 moves the infrared ray temperature detecting elements 41*a*–41*c* in the direction of the arrow S and places them at the stand-by area 810. Furthermore, the moving mechanism 850 moves the infrared ray temperature detecting elements 41*a*–41*c* in the direction of the arrow Q to place them at the stand-by area 860.

Furthermore, in the site in which the temperature signal conversion circuit board is arranged and which is rarely affected by infrared rays, an atmosphere temperature detecting mechanism for detecting the temperature of the atmosphere may be provided.

Based on the temperature detecting signal SG1 output from the temperature detecting circuit 23, temperature correction explained in the first embodiment may be carried out.

What is claimed is:

1. A fixing apparatus comprising:

a heating roller a surface of which is formed of a conductive material;

a heating unit that is configured to heat the heating roller;

a temperature detecting mechanism having one or more non-contact temperature detecting units that are arranged in non-contact with the surface of the heating roller and that are configured to detect the surface temperature of the heating roller by sensing infrared rays emitted from the heating roller; and a correction circuit that is configured to correct information as to the surface temperature of the heating roller output from the non-contact temperature detecting unit(s) based on a predetermined correction coefficient, wherein the correction circuit is configured: (a) to execute temperature correction of the heating roller during a warming-up time; and (b) not to execute temperature correction when it is reported to require cleaning or exchange of a non-heating roller or the non-contact temperature detecting unit(s).

2. The fixing apparatus according to claim 1, wherein the correction coefficient is determined depending upon the number of paper sheets serving as an image recording medium.

3. The fixing apparatus according to claim 1, wherein the heating unit has induction heating means having a coil which generates magnetic flux upon supplying a predetermined power thereto and heats the heating roller by induction.

4. The fixing apparatus according to claim 3, wherein the coil is arranged outside the heating roller.

5. The fixing apparatus according to claim 1, wherein said one or more non-contact temperature detecting units are arranged in the axial direction of the heating roller.

6. The fixing apparatus according to claim 5, wherein the non-contact temperature detecting units are arranged in a rotation direction of the heating roller at different phases.

7. The fixing apparatus according to claim 1, wherein each of the temperature detecting unit(s) has a circuit board for converting the temperature information output from the associated non-contact temperature detecting unit into an electric signal, and wherein each of the circuit board(s) is positioned at a site rarely affected by infrared rays from the heating roller.

8. The fixing apparatus according to claim 1, further comprising:

a moving mechanism which movably holds the non-contact temperature detecting unit(s) and moves the non-contact temperature detecting unit(s) to a predetermined detection position near the surface of the heating roller when the heating roller generates heat and moves the non-contact temperature detecting unit(s) to a standby area during an operation other than a fusing/fixing step.

9. A method of correcting temperature comprising:

detecting the temperature of a heating roller by use of a non-contact temperature detecting unit;

correcting the detected temperature based on a predetermined correction coefficient when the temperature detected by the non-contact temperature detecting unit falls within a temperature correction range wherein the temperature detected by the non-contact temperature detecting unit is corrected during a warming-up time and not corrected when the detected temperature falls within a range requiring cleaning or exchange.

10. The method according to claim 9, further comprising measuring the temperature of the heating roller for a predetermined heating time, and giving, when the detected temperature falls within a range requiring cleaning or exchange, at least one of messages that the non-contact temperature detecting unit should be cleaned and that the heating roller should be cleaned or exchanged.

11. The method according to claim 9, wherein the correction coefficient is set depending upon the number of recording mediums passing through a nip portion formed on the outer peripheral surface of the heating roller.

12. A fixing apparatus comprising:

a heating roller a surface of which is formed of a conductive material;

a heating unit that is configured to heat the heating roller;

a temperature detecting mechanism including first and second temperature detecting units and a signal output section; and a moving mechanism that movably holds the first and second temperature detecting units and that is configured to: (a) move the first temperature detecting unit to a predetermined detection position near the heating roller when the heating roller generates heat; and (b) move the second temperature detecting unit to a standby area during an operation other than fusion/fixation, wherein the first temperature detecting unit is arranged in non-contact with the surface of the heating roller and is configured to detect the surface temperature of the heating roller by sensing infrared rays emitted from the heating roller, and wherein the signal output section: (a) is arranged at a predetermined site rarely affected by infrared rays emitted from the heating roller; and (b) is configured to convert the information as to the surface temperature of the heating roller from the first temperature detecting unit into an electric signal.

13. The fixing apparatus according to claim 12, wherein the signal output section is placed in a case which can mitigate effects of infrared rays and thermal convection.

14. The fixing apparatus according to claim 12, wherein the heating unit has induction heating means having a coil that is configured to generate magnetic flux upon supplying a predetermined power thereto and to heat the heating roller by induction.

15. The fixing apparatus according to claim 12, wherein the temperature detecting units are arranged in the axial direction of the heating roller.

16. The fixing apparatus according to claim 15, wherein the temperature detecting units are arranged in a rotation direction of the heating roller at different phases.

17. A fixing apparatus comprising:

a heating roller comprising a conductive material;

a heating unit that is configured to heat the heating roller;

a temperature detector that is configured to: (a) detect a temperature of the heating roller; and (b) output a signal in accordance with the temperature of the heating roller;

a temperature detecting circuit that is configured to convert the signal to temperature information;

a timer configured to measure a predetermined time;

a correction circuit that is configured to correct the temperature information based on a predetermined condition; and a control circuit that is configured to control the correction circuit to execute correction of the temperature information when the temperature detecting circuit fails to detect a predetermined temperature within the predetermined time while executing warming-up.

18. The fixing apparatus according to claim 17, further comprising:

a counter that is configured to count a number of paper sheets that have passed the fixing apparatus, wherein the correction circuit is configured to determine a correction coefficient based on the number of sheets counted by the counter.

19. The fixing apparatus according to claim 17, wherein the heating unit includes a plurality of coils, which are arranged in a longitudinal direction of the heating roller.

20. The fixing apparatus according to claim 19, wherein the temperature detector is configured to detect temperatures at a central position of a heat-generating section of the coils and at a joint section where the coils face each other.

21. The fixing apparatus according to claim 17, wherein the temperature detector is configured to detect infrared radiation from the heating roller.

* * * * *